US012759767B2

(12) United States Patent
Zimmerman et al.

(10) Patent No.: US 12,759,767 B2
(45) Date of Patent: Oct. 13, 2026

(54) CONTAINER, CLOSURE, AND METHODS OF MANUFACTURE AND USE

(71) Applicant: H.J. Heinz Company Brands LLC, Pittburgh, PA (US)

(72) Inventors: Daniel M. Zimmerman, Glen Ellyn, IL (US); John Kevin Clay, Milford, CT (US); James E. McCay, Fairfield, CT (US)

(73) Assignee: H.J. Heinz Company Brands LLC, Pittsburgh, PA (US)

( * ) Notice: Subject to any disclaimer, the term of this patent is extended or adjusted under 35 U.S.C. 154(b) by 67 days.

(21) Appl. No.: 18/716,493

(22) PCT Filed: Dec. 8, 2022

(86) PCT No.: PCT/US2022/052246
§ 371 (c)(1),
(2) Date: Jun. 4, 2024

(87) PCT Pub. No.: WO2023/107615
PCT Pub. Date: Jun. 15, 2023

(65) Prior Publication Data

US 2025/0051063 A1 Feb. 13, 2025

Related U.S. Application Data

(60) Provisional application No. 63/288,347, filed on Dec. 10, 2021.

(51) Int. Cl.
*B65D 47/08* (2006.01)
*B65D 51/20* (2006.01)

(52) U.S. Cl.
CPC ..... *B65D 47/0838* (2013.01); *B65D 51/20* (2013.01); *B65D 2251/0093* (2013.01)

(58) Field of Classification Search
CPC ..... B65D 47/0838; B65D 51/20; B65D 2251/0093; B65D 47/061; B65D 51/18; B65D 41/04; B65D 47/24; B65D 5/748
See application file for complete search history.

(56) References Cited

U.S. PATENT DOCUMENTS 2,964,208 A 12/1960 Heyl
3,973,690 A * 8/1976 Schneider ..... B65D 41/0435 215/346

(Continued)

FOREIGN PATENT DOCUMENTS

CN 2837228 Y 11/2006
CN 101734417 A 6/2010

(Continued)

OTHER PUBLICATIONS

Image of the interior of a cap believed publicly available as early as Dec. 10, 2021.

(Continued)

*Primary Examiner* — James N Smalley
(74) *Attorney, Agent, or Firm* — Fitch, Even, Tabin & Flannery LLP

(57) ABSTRACT

A dispensing bottle is provided including a closure cap having a base that includes a central member with an opening for fluid to flow through and an inner skirt for securing the closure cap to a container body. The base further includes an internal shaft about the opening of the base and having threads thereon to which a movable tube is threaded onto to thereby form an expandable serum well. The movable tube has an extension that engages at least one of a neck of the container body and a liner secured to the neck such that when the closure cap is at least partially unthreaded from the container body the movable tube is retained in position relative to the at least one of the (Continued)

container body and the liner to thereby expand the expandable serum well as the closure cap is unthreaded from the container body.

31 Claims, 5 Drawing Sheets

(56) References Cited

U.S. PATENT DOCUMENTS

| | | | | |
|---|---|---|---|---|
| 4,158,902 | A | 6/1979 | Chernack | |
| 6,164,503 | A | 12/2000 | Forsyth | |
| 6,477,743 | B1 * | 11/2002 | Gross | B65D 51/226 222/499 |
| 6,689,279 | B1 | 2/2004 | Train | |
| 6,702,161 | B2 * | 3/2004 | Adams | B65D 51/227 206/532 |
| 7,036,683 | B2 * | 5/2006 | Dubach | B65D 5/748 222/83 |
| 7,549,547 | B2 * | 6/2009 | Herr | B65D 55/022 215/351 |
| 8,496,129 | B2 * | 7/2013 | Isogai | B65D 51/228 222/541.6 |
| 8,573,423 | B2 | 11/2013 | Mcgeough | |
| 11,708,191 | B2 * | 7/2023 | Silla | B65D 55/16 215/200 |
| 2004/0173644 | A1 * | 9/2004 | Ramsey | B65D 5/748 222/519 |
| 2004/0217083 | A1 | 11/2004 | Mavin | |
| 2005/0184092 | A1 | 8/2005 | Illuzzi | |
| 2005/0279781 | A1 | 12/2005 | Pugne | |
| 2007/0251079 | A1 | 11/2007 | Pugne | |
| 2007/0267304 | A1 | 11/2007 | Portier | |
| 2009/0050648 | A1 * | 2/2009 | Wisniewski | B65D 51/226 222/494 |
| 2010/0072231 | A1 | 3/2010 | Bloom | |
| 2013/0043277 | A1 | 2/2013 | Lepage | |
| 2015/0329233 | A1 | 11/2015 | Staples | |
| 2020/0071041 | A1 | 3/2020 | Sahara | |
| 2025/0011053 | A1 * | 1/2025 | Santos | A61J 15/00 |

FOREIGN PATENT DOCUMENTS

| | | | |
|---|---|---|---|
| CN | 110461724 | A | 11/2019 |
| CN | 210618954 | U | 5/2020 |
| EP | 2181932 | A1 | 5/2010 |
| JP | H0631247 | | 11/1994 |
| JP | 2010023873 | | 2/2010 |
| JP | 2010260589 | A | 11/2010 |
| JP | 2019011099 | | 1/2019 |
| WO | 2006115424 | A1 | 11/2006 |
| WO | 2008046782 | A1 | 4/2008 |
| WO | 2012138637 | | 10/2012 |
| WO | 2015105422 | | 7/2015 |
| WO | 2020132247 | | 6/2020 |
| WO | 2021055067 | | 3/2021 |

OTHER PUBLICATIONS

Patent Cooperation Treaty; International Search Report for International Application PCT/US2022/052246 mailed Apr. 20, 2023; 3 pages.

Patent Cooperation Treaty; International Preliminary Report on Patentability and Written Opinion for International Application PCT/US2022/052246 issued Jun. 5, 2024; 6 pages.

Patent Cooperation Treaty; International Search Report for International Application PCT/US2022/052242 mailed Apr. 26, 2023; 5 pages.

Patent Cooperation Treaty; International Preliminary Report on Patentability and Written Opinion for International Application PCT/US2022/052242 issued Jun. 5, 2024; 7 pages.

* cited by examiner

CONTAINER, CLOSURE, AND METHODS OF MANUFACTURE AND USE

CROSS-REFERENCE TO RELATED APPLICATION(S)

This application is the national phase of PCT/US22/52246 filed Dec. 8, 2022, which claims the benefit of U.S. Provisional Application No. 63/288,347, filed Dec. 10, 2021, which is incorporated by reference in its entirety.

FIELD

This disclosure relates generally to containers for fluids and, more particularly, to containers with closure caps for dispensing fluid.

BACKGROUND

Product separation is an issue that arises with many fluid products that have two or more fluid types in a mixture. Product separation often results as the fluid product settles over time with a lower density fluid separating from a higher density fluid of the fluid product. For instance, a thin or relatively low viscosity, low density fluid may separate from the remainder of a fluid and rest on top of the remainder of the fluid. One example of such a fluid where product separation is prone to occur is ketchup. Over time, serum or water separates from the remainder of the ketchup fluid, with the serum or water rising to the top of the fluid mixture. Product separation is undesirable in many applications and particularly in applications where the fluid product is dispensed directly from a container where the user may not be aware that product separation has occurred. As a result of product separation, when a user dispenses the fluid from the fluid container, the low viscosity, low density fluid may be dispensed separately from the remainder of the product rather than as a mixed fluid product. Dispensing the lower viscosity fluid may result in increased splatter as the user dispenses the fluid from the fluid container. Moreover, the thin or lower viscosity fluids may more readily leak from the fluid container.

Some have attempted to address these problems by using a dispensing cap with a bottle that facilitates mixing of the fluid within the bottle as the fluid is dispensed. These dispensing caps, however, are often large in size, having intricate internal pieces and mixing channels within the closure cap. Such dispensing caps are generally expensive to manufacture and are overly large which makes them difficult to ship and store (e.g., take up too much shelf space in the store and/or at home).

DETAILED DESCRIPTION

Figure 1:
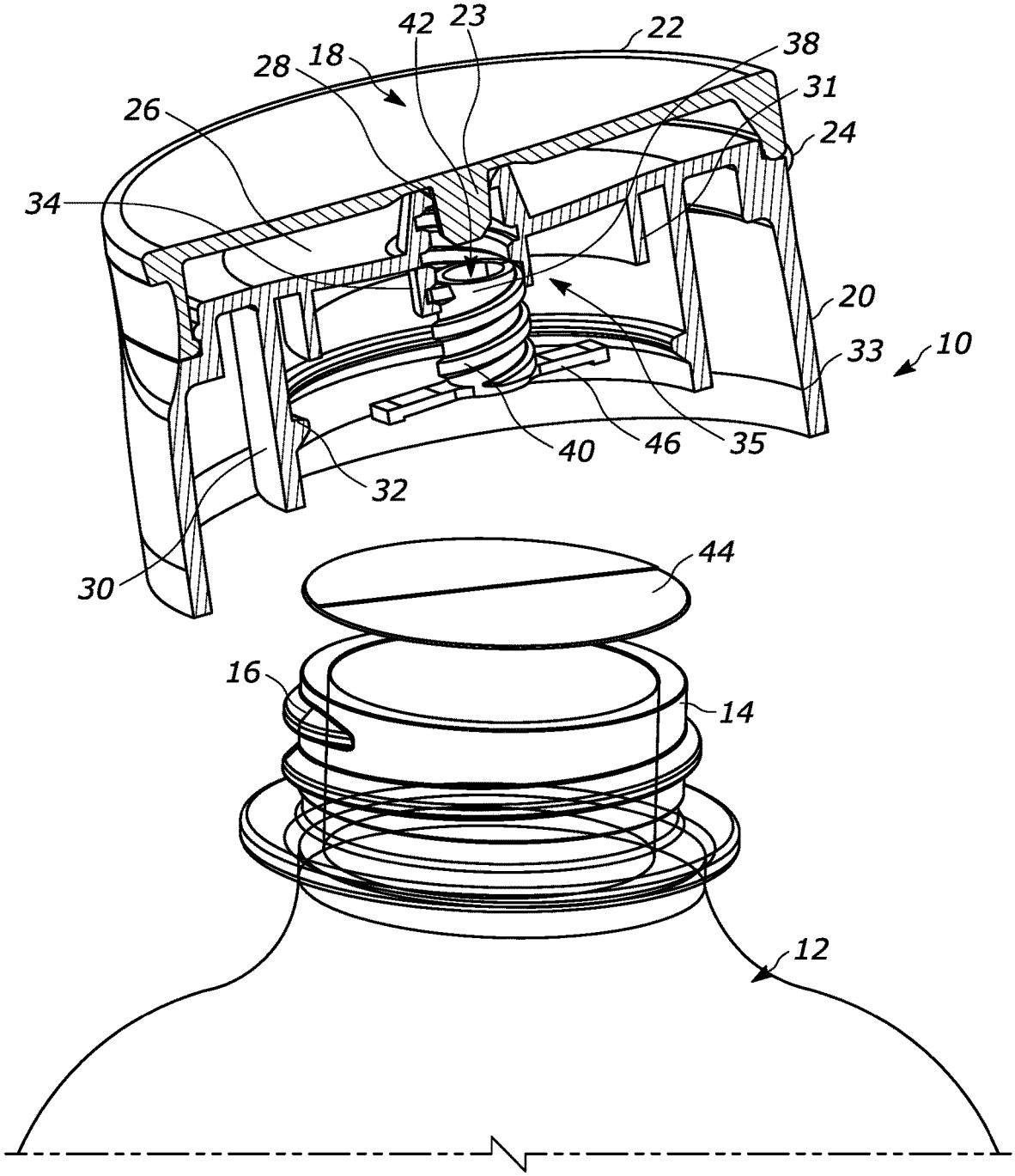
FIG. 1 is a partial cross-sectional view of a dispensing bottle in a disassembled configuration and including a container, a closure cap, and a liner.

Described herein are systems, apparatus and methods for dispensing a fluid from a bottle, such as, consumer or food products including, e.g., condiments or drinks. In some embodiments, a bottle includes a closure cap with a flip-top lid, and a base that is configured to facilitate dispense fully mixed product and prevent discharge of separated constituents, such as, e.g., watery serum. In some configurations, the base includes a serum well that captures or retains at least some of the separated serum, thereby prevent it from discharging from the closure cap, at least until this separated serum has been sufficiently mixed into a remainder of the fluid. While some previous solutions required complicated or large closure caps, others suffered from a decrease in functionality. For example, certain closure caps that prevented the discharge of serum, also required a very large internal pressure to eject the fluid therefrom, thereby requiring the consumer to apply a larger force to the outside of the dispensing bottle.

With respect to FIGS. 1-5, a dispensing bottle 10 is shown that facilitates mixing of the constituent parts of the fluid prior to discharge from the closure cap and/or prevents separated fluid from being dispensed from a container body 12. In addition, the closure cap 18 also prevents unintentional discharge of fluid therethrough. The dispensing bottle 10 may be inverted, such that a closure cap 18 is at the bottom of dispensing bottle 10, to dispense fluid out of the dispensing bottle 10 through the closure cap 18. In addition, the dispensing bottle 10 also may be stored while resting on its closure cap 18, therefore the closure cap 18 typically includes structure to both sufficiently retain the fluid in the bottle 10 when the closure cap 18 is in the closed configuration and the container body 12 is disposed above the closure cap 18 and to mix the fluid prior to discharge from the dispensing bottle 10.

In one illustrative configuration, the dispensing bottle 10 includes a serum trap or serum well 50 (see FIGS. 4 and 5) for the separated fluid (e.g., serum) to flow into where the separated fluid is not able to flow out of the dispensing bottle 10 and be dispensed to the user. By one approach, the serum well 50 is formed by an extendable tube 35 that extends into the container body 12 after initial opening and serves as a tube or snorkel to draw fluid from further into the container body 12 to be dispensed to the user. For example, where serum or water has separated from the fluid (e.g., ketchup), as the dispensing bottle 10 is inverted to dispense fluid, the serum or water flows into the serum well 50 and below the end of the extendable tube 35. The mixed or unseparated fluid flows on top of the serum within the serum well 50, trapping the separated fluid within the serum well and preventing the separated fluid from flowing into a fluid flow channel 42 formed by the extendable tube 35 and thus out of the dispensing bottle 10. The mixed or unseparated fluid outside of the serum well 50 and above the end of the extendable tube 35 is able to flow into the fluid flow channel 42 and out of the dispensing bottle 10.

The dispensing bottle 10 includes a closure cap 18 that has a relatively low profile. The dispensing bottle 10 addresses problems associated with separated fluid while having a lower profile by including an extendable tube 35 that may be extended into the neck 14 of the container body 12 once a liner 44 has been removed instead of increasing the size of the closure cap 18. Thus, the dispensing bottle 10 has a smaller size that is more easily shipped and/or stored. The dispensing bottle 10 is also more readily able to be manufactured as the closure cap 18 includes few pieces without intricate internal components or complex mixing flow paths within the closure cap 18.

With respect to FIG. 1, the dispensing bottle 10 includes the container body 12, a closure cap 18, and a liner 44. The container body 12 is a receptacle for receiving and storing fluid (e.g., thixotropic fluid), such as a fluid food product and other consumer fluid products. Examples of fluid food products include, as examples, ketchup, mayonnaise, barbecue sauce, mustard. Examples of other consumer fluid products include soap, detergent, lotion, shampoo, and conditioner. The container body 12 has a neck 14 defining an opening through which the container body 12 may be filled with fluid and through which the fluid may be dispensed from the container body 12. The neck 14 of the container body 12 includes neck threads 16 disposed on the outer surface of the neck 14. The neck threads 16 may be used to secure the closure cap 18 to the neck 14 of the container body 12. The container body 12 may be formed of a plastic material, such as, polypropelene, polyethylene (e.g., HDPE, LDPE, LLDPE, MDPE, HMWPE), polyethylene terephthalate or other food grade plastic or polymer. The container body 12 may be transparent or translucent enabling a user to see through the container body 12, for example, to view the fluid of the container body 12 and/or determine the amount of fluid remaining in the container body 12. The container body 12 may be flexible enabling a user to squeeze the container body 12 to reduce the volume of the container body 12 and force fluid out of the container body 12 to dispense the fluid. The container body 12 may be configured to elastically rebound to its original shape when a user ceases to squeeze or apply a force to the container body 12.

The closure cap 18 includes a base 20 and a flip-top lid 22 hingedly connected to the base 20 via hinge 24. The flip-top lid 22 may be moved between open (not shown) and closed positions about the hinge 24. The base 20 of the closure cap 18 includes a central member 26 with a dispensing opening 28 therein for fluid to flow through the closure cap 18 to dispense the fluid within the container body 12. The closure cap 18 may be attached to the neck 14 of the container body 12 and the flip-top lid 22 moved between open and closed positions to selectively permit fluid to exit the container body 12 through the dispensing opening 28. The flip-top lid 22 may prevent fluid from exiting the dispensing opening 28 when the flip-top lid 22 is closed and may permit fluid to exit the opening 28 when the flip-top lid 22 is open. The flip-top lid 22 may include a projection 23 that closes or plugs the opening 28 when the flip-top lid 22 is in the closed position. The projection 23 may be at least partially inserted into the opening 28 to plug the opening 28. The projection 23 may be removed from the opening 28 when the flip-top lid 22 is moved toward the open position to thereby permit fluid to exit the opening 28.

The base 20 of the closure cap 18 includes an inner skirt 30 and an optional annular ring 31 depending from the central member 26. The base 20 may further include an outer skirt 33 depending from the central member 26. The inner skirt 30, the annular ring 31, and the outer skirt 33 may be substantially concentric with the opening 28 of the base 20. The inner skirt 30 has skirt threads 32 disposed on an inner surface thereof that correspond to the neck threads 16 of the container body 12. The closure cap 18 may be secured to the container body 12 by threading the skirt threads 32 of the base 20 to the neck threads 16 of the neck 14 of the container body 12.

In some configurations, the annular ring 31 is disposed within the inner skirt 30 and supports the liner 44 before the liner 44 is secured to the neck 14 of the container body 12 (after filling thereof). For example, the liner 44 may be positioned within the cavity formed by the inner skirt 30 and rest on or be attached to the annular ring 31. In some forms, the upper surface of the liner 44 is secured to the annular ring 31 by an adhesive. When the closure cap 18 is initially secured to the container body 12, the liner 44 is brought into contact with the neck 14 of the container body 12 and may be secured thereto to seal the liner 44 to the container body 12. The annular ring 31 may hold or force the liner 44 into engagement with the neck 14 of the container body 12 as the liner 44 is sealed thereto (e.g., by induction sealing). The outer skirt 33 may depend from an outer edge of the central member 26. The outer skirt 33 may form a shell about the inner skirt 30 and the neck 14 of the container body 12. In yet other configurations, the liner 44 may be applied to the bottle neck in a step prior threading of the closure cap 18 onto the bottle neck.

The base 20 further includes an internal shaft 34 disposed on the central member 26 and about the opening 28. The internal shaft 34 may be disposed on an internal surface of the central member 26. The internal shaft 34 may extend from or even through the central member 26. In some configurations, the internal shaft 34 is unitarily formed with the base 20 and rigidly secured to the central member 26. In one exemplary embodiment, the internal shaft 34 has threads 36 disposed thereon that engage or thread onto the threads 40 of an extension or movable tube 38. In some configurations, the movable tube 38 is formed separately from the remainder of the closure cap 18 and is subsequently associated therewith in a manner such that it is able to move relative to the remainder of the closure cap 18. In the embodiment shown, the threads 36 of the internal shaft 34 are disposed on an internal surface of the internal shaft 34 and the threads 40 of the movable tube 38 are disposed on an external surface thereof. This may be switched, such that, in other embodiments, the threads 36 of the internal shaft 34 are disposed on an outer surface of the internal shaft 34 and the threads 40 of the movable tube 38 are disposed on an inner surface thereof. Together, the internal shaft 34 and the movable tube 38 form an extendable tube 35 with a fluid flow channel 42 therethrough (see FIG. 4). Fluid may enter the inlet end 41 of the movable tube 38 opposite the central member 26 and flow along the internal fluid flow channel 42 formed by the movable tube 38 and the internal shaft 34 to the opening 28 of the base 20 of the closure cap 18.

In some configurations, the movable tube 38 may be rotated relative to the internal shaft 34 to thread or unthread the movable tube 38. Further, as the movable tube 38 is rotated relative to the internal shaft 34, the movable tube 38 advances from a retracted position into an extended position. In this manner, the movable tube 38 being switched from the first position to the second position adjusts or extends the axial length of the extendable tube 35 or fluid flow channel 42 that is formed by the movable tube 38 and the internal shaft 34. The movable tube 38 and the internal shaft 34 thereby form an extendable tube 35 that has a first axial length when in the retracted configuration and a second axial length greater than the first axial length when in the extended configuration. As the movable tube 38 is rotated toward the extended configuration, the inlet end 41 of the movable tube 38 is moved away from the central member 26 and the length of the fluid flow channel 42 is increased relative to the length of the fluid flow channel 42 in the retracted configuration. The movable tube 38 is thus configured to form an expandable serum well 50 discussed in further detail below (see FIGS. 4 and 5). The retracted configuration or first axial length of the extendable tube 35 may be employed for storage and shipping and the extended configuration or second axial length may be employed during use of the dispensing bottle 10 for dispensing of the fluid through the opening 28 of the closure cap 18.

In some embodiments, the movable tube 38 and/or the internal shaft 34 includes a stop, retention, or detent mechanism for preventing the movable tube 38 from becoming detached, disengaged, unthreaded or otherwise separated from the remainder of the closure cap 18. The stop or retention mechanism may prevent the movable tube 38 from rotating relative to the closure cap 18 once the movable tube 38 is fully moved to the extended configuration. By one approach, the movable tube 38 or the internal shaft 34 includes a depression or cavity that is configured to receive an extension element disposed on the other of the moveable tube 38 or the internal shaft 34.

Figure 6A:
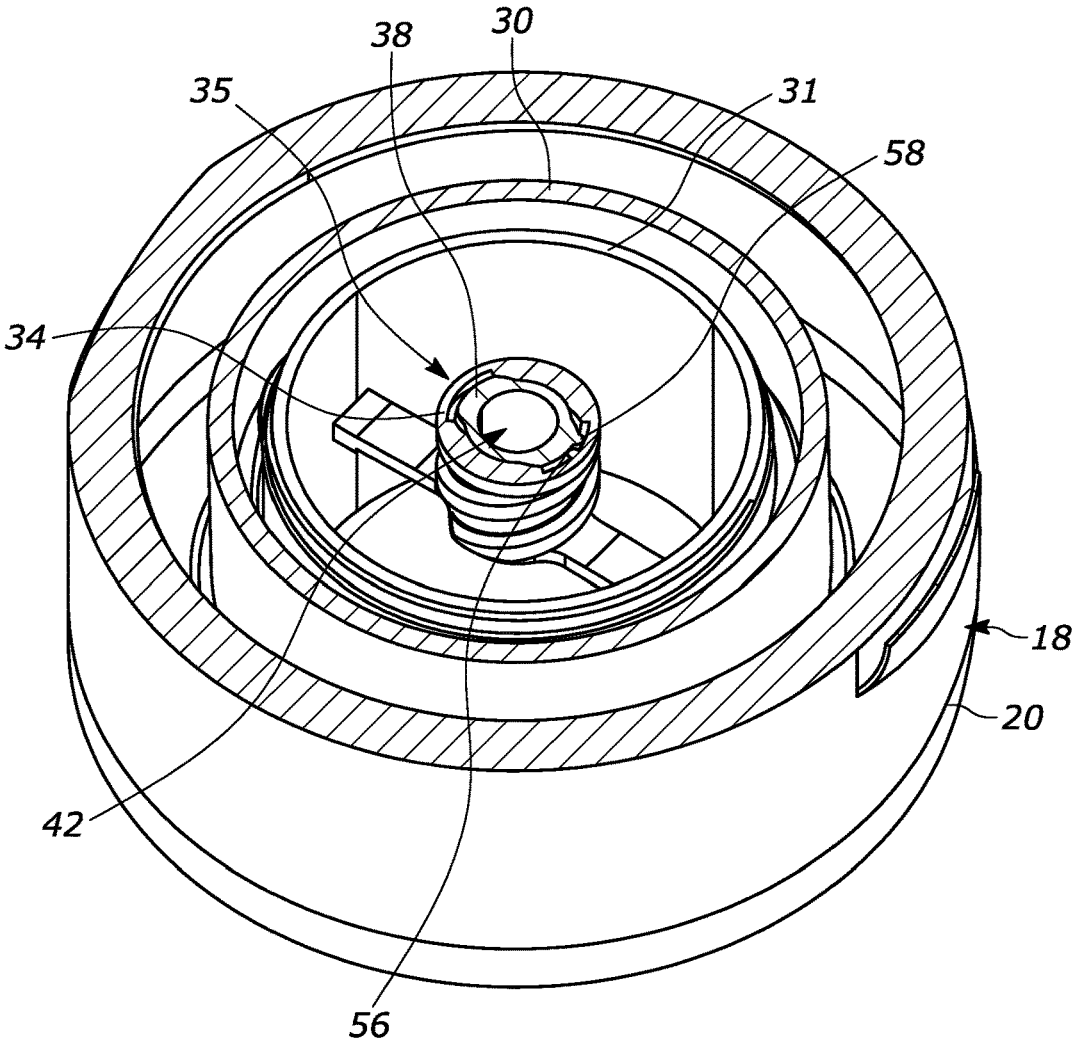
FIG. 6A is a top perspective cross-sectional view of the closure cap of the dispensing bottle of FIG. 1 illustrating a retention mechanism of the extendable tube.
Figure 6B:
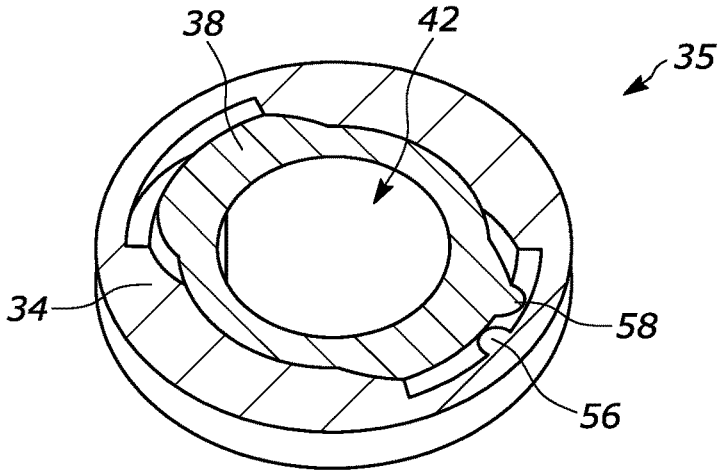
FIG. 6B is a closeup view of the retention mechanism of the extendable tube as shown in FIG. 6A.

By another approach, such as that shown in FIGS. 6A and 6B, the internal shaft 34 includes a protrusion or stop 56 along the threads and the movable tube 38 includes a corresponding protrusion 58. As shown, the protrusion 58 of the movable tube 38 extends radially outward from the threads 40 of the movable tube 38. The stop 56 of the internal shaft 34 may extend radially inward and into the path of the protrusion 58 of the movable tube 38. When the movable tube 38 is fully unthreaded from the remainder of the closure cap 18, the protrusion 58 of the movable tube 38 abuts the stop 56 of the internal shaft 34, thereby preventing the movable tube 38 from unthreading any further without substantial force. This prevents the movable tube 38 from becoming disconnected from the remainder of the closure cap 18. In some configurations, the protrusion 58 may be a detent that locks the movable tube 38 in the extended configuration when the movable tube 38 is fully unthreaded.

When the movable tube 38 is in the retracted configuration, the height or distance from the bottom surface of the central member 26 to the inlet end 41 of the movable tube 38 may be in the range of about 1 mm to about 10 mm and, in one specific example 4.5 mm. When the movable tube 38 is in the extended configuration, the height or distance from the bottom surface of the central member 26 to the inlet end 41 of the movable tube 38 may be in the range of about 5 mm to about 15 mm and, in one specific example 10 mm.

In other embodiments, the extendable tube 35 is a telescoping tube where the movable tube 38 is extended or moved away from the central member 26 to increase the axial length of the extendable tube 35. In some forms, the extendable tube 35 includes a spring or other biasing member that forces the movable tube 38 toward the extended configuration. The movable tube 38 may remain in the retracted configuration when in engagement with the liner 44 when the liner 44 is affixed to the neck 14 of the container body 12 and, when the liner 44 is removed, be biased toward the extended configuration and extend into the neck 14 of the container body 12.

Figure 2:
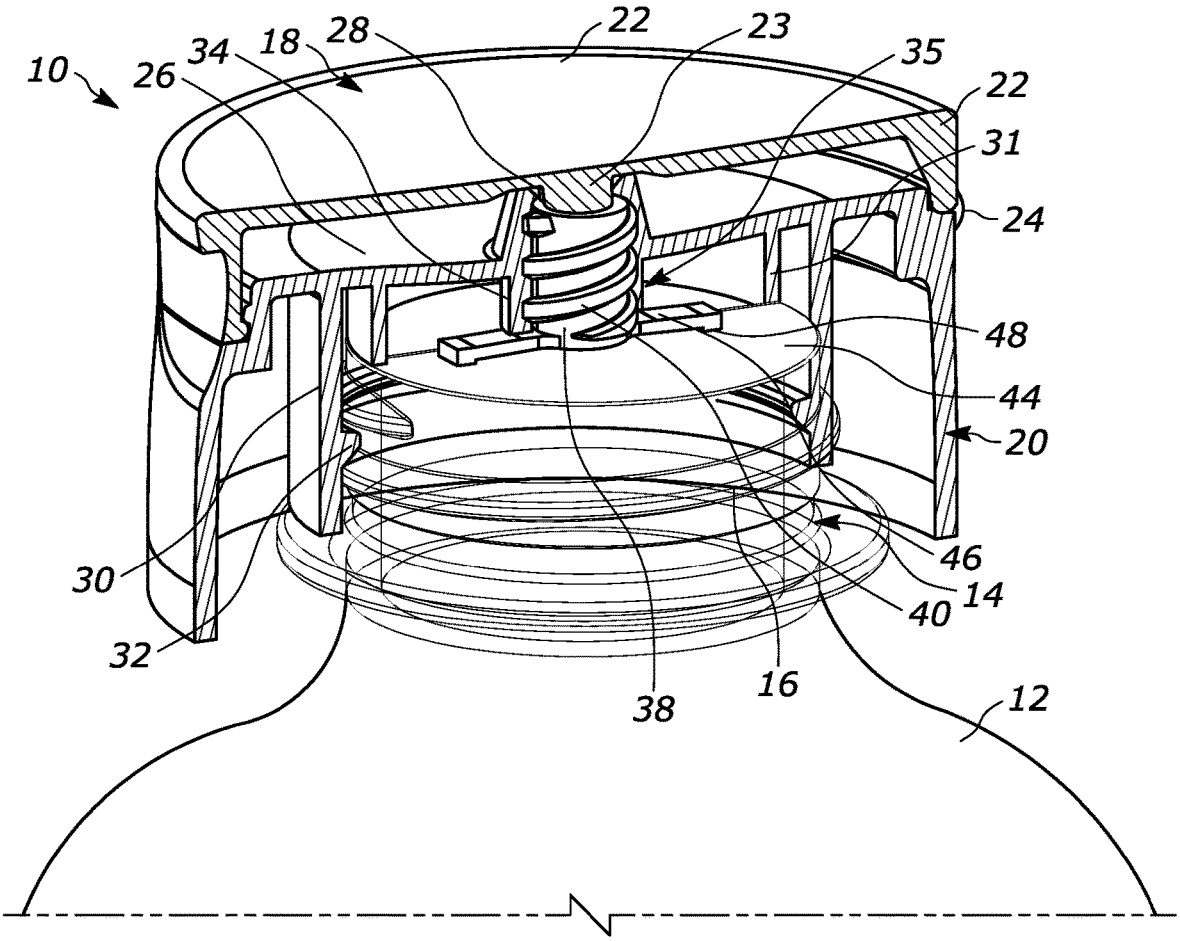
FIG. 2 is a partial cross-sectional view of the dispensing bottle of FIG. 1 in an assembled configuration with an extendable tube of the closure cap in a retracted configuration.
Figure 3:
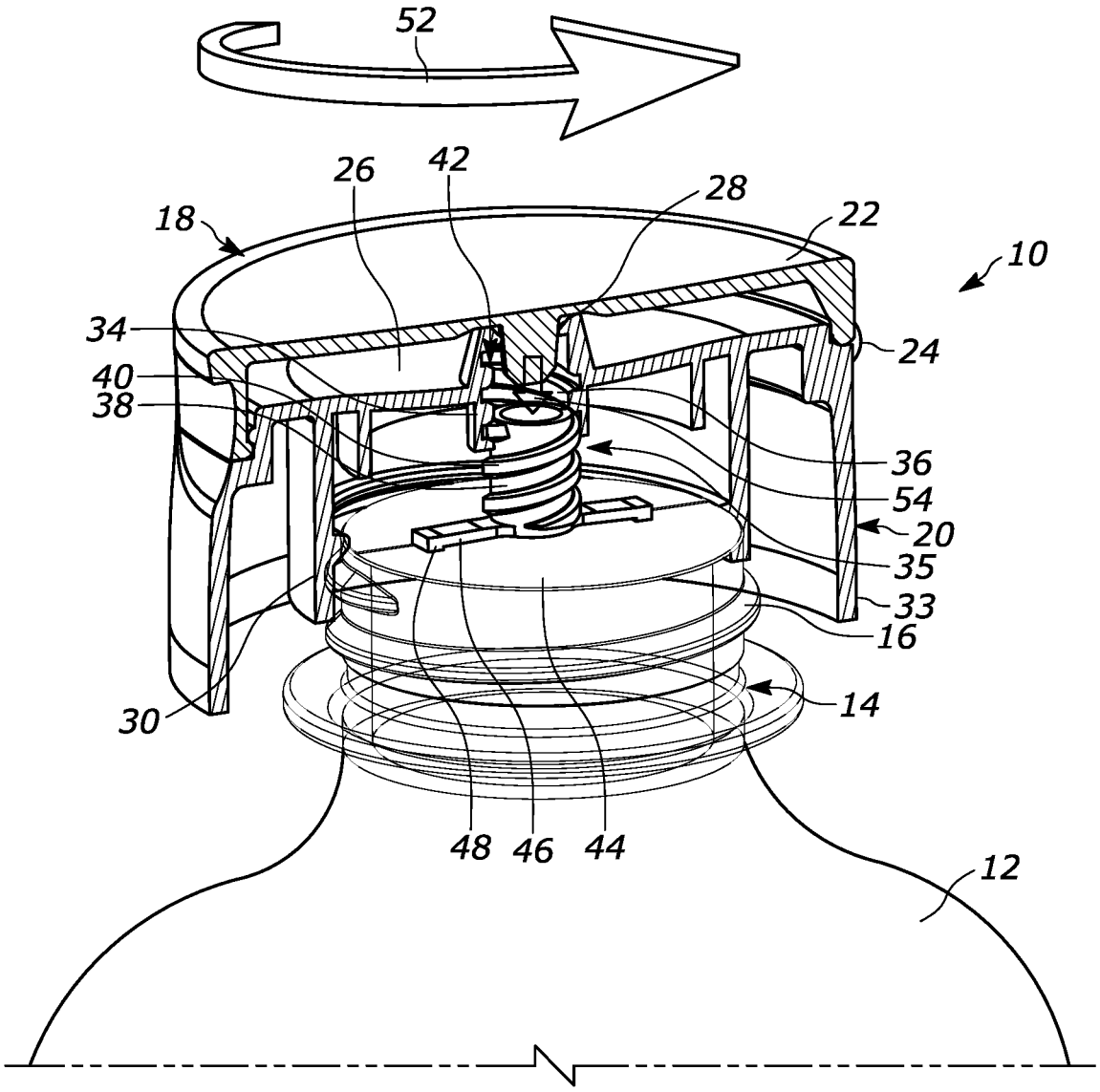
FIG. 3 is a partial cross-sectional view of the dispensing bottle of FIG. 1 with the closure cap partially removed from the container and the extendable tube in an extended configuration.

With respect to FIGS. 2 and 3, the movable tube 38 may include an engagement base or extension 46 at the end thereof that engages the liner 44 when the closure cap 18 is at least partially secured to the container body 12 with the liner 44 affixed to the neck 14. In some configurations, the extension 46 of the movable tube 38 includes a pair of tabs or extension arms extending radially from the movable tube 38. In other forms, the extension 46 may have other configurations (e.g., additional arms, circular elements or pieces) to increase the area of the extension 46 that engages the liner 44. In some approaches, the extension 46 of the movable tube 38 engages the liner 44 such that the movable tube 38 does not rotate substantially relative to the liner 44 and/or container body 12 as the closure cap 18 is unthreaded from the neck of the container, i.e., rotated relative to the container body 12 to remove the closure cap 18 from the container body 12 (thereby permitting a user to peel away the liner from the bottle neck). For instance, the extension 46 of the movable tube 38 may engage or hook a pull tab of the liner 44 to prevent the movable tube 38 from rotating with the remainder of the closure cap 18 as the closure cap 18 is unthreaded from the container body 12. In one illustrative embodiment, each extension arm includes a fin 48 for engaging or attaching to the liner 44. In one form, the fins 48 have generally flat surfaces on the extension arms that aid in engaging or hooking the top or upper surface of the liner 44 to prevent the movable tube 38 from rotating relative to the liner 44. As one example, the fins 48 are pressed into frictional engagement with the liner 44. The liner 44 may include a step or other feature that the fins 48 and/or extension arms hook to prevent the movable tube 38 from rotating relative to the liner 44 when a remainder of the closure cap 18 is unscrewed from the body 12 as described in further detail below.

In another example, the fins 48 may be secured to the upper surface of the liner 44, such as by an adhesive. Additionally, or alternatively, the extension 46 of the movable tube 38 engages a portion of the neck 14 of the container body 12. In one such approach, the neck 14 may include a notch or protrusion that the extension 46 engages to prevent the movable tube 38 from rotating substantially relative to the container body 12 during the unthreading of the closure cap from the container body. Because the movable tube 38 is prevented from rotating relative to the liner 44 by the extension 46, as the closure cap 18 is unthreaded from the container body 12 by rotating the closure cap 18 as shown by arrow 52 (see FIG. 3), the movable tube 38 is unthreaded from the internal shaft 34 and moves toward the extended configuration in the direction of arrow 54. As a result, when the closure cap 18 is initially removed from the container body 12 to remove the liner 44, the movable tube 38 is concurrently moved to the extended configuration.

The closure cap 18 may be formed of a plastic material, such as, polypropelene, polyethylene, polyethylene terephthalate or other food grade plastic or polymer. In some configurations, the closure cap 18, apart from the movable tube 38, is formed as a single piece, for example by injection molding. The movable tube 38 may be formed separately, for example, by injection molding. The movable tube 38 may be threaded into the internal shaft 34 of the closure cap 18 to form the closure cap 18.

After the container body 12 is filled, the liner 44 is disposed at the neck 14 of the container body 12. The liner 44 seals the contents of the container body 12 therein and prevents fluid from entering or exiting the container body 12 prior to use of the bottle by a consumer. The liner 44 may form a hermetic seal with the neck 14 of the container body 12. The liner 44 may be formed by one or more layers that are then adhered to the neck 14 and sealed to the container body 12. As one example, the liner 44 may be an induction seal. In some forms, the lower surface of the liner 44 includes an adhesive that bonds the liner 44 to the neck 14 of the container body 12. The liner 44 may be used to prevent the fluid food product (e.g., condiment) within the container body 12 from spoiling and to prolong the shelf life of the dispensing bottle 10. The liner 44 may include a lower surface that seals to the rim of the neck 14 of the container body 12. The liner 44 may be removable from the neck 14 of the container body 12 to access the contents of the container body 12 by, for example, peeling the liner 44 from the neck 14 of the container body 12. The liner 44 may include a tab that a user may grip or grab onto to aid in removing the liner 44. When the closure cap 18 is removed from the container body 12, the liner 44 may remain attached to the neck of the container body 12. The liner 44 may thus serve as a tamper evident seal indicating, for example, whether the contents of the container body 12 have been previously accessed. The liner 44 may be peeled off of the neck of the container body 12 to provide access to the fluid within the container body 12. Once the liner 44 is removed, the closure cap 18 may be reattached to the neck 14 of the container body 12 and fluid may be dispensed through the opening 28 of the closure cap.

As mentioned above, the upper surface of the liner 44 may be configured to engage the extension 46 of the movable tube 38 to prevent the movable tube 38 from rotating substantially relative to the liner 44. The upper surface of the liner 44 may be non-planar and include a step, ledge, ridge, pocket, or other feature that the extension 46 of the movable tube 38 may hook, snag, or be inserted into such that the movable tube 38 is prevented from rotating with the closure cap 18 as the closure cap 18 is unthreaded from the container body 12. Thus, as the closure cap 18 is removed or unthreaded from the container body 12, the movable tube 38 is moved to the extended configuration being held stationary by the liner 44.

Figure 4:
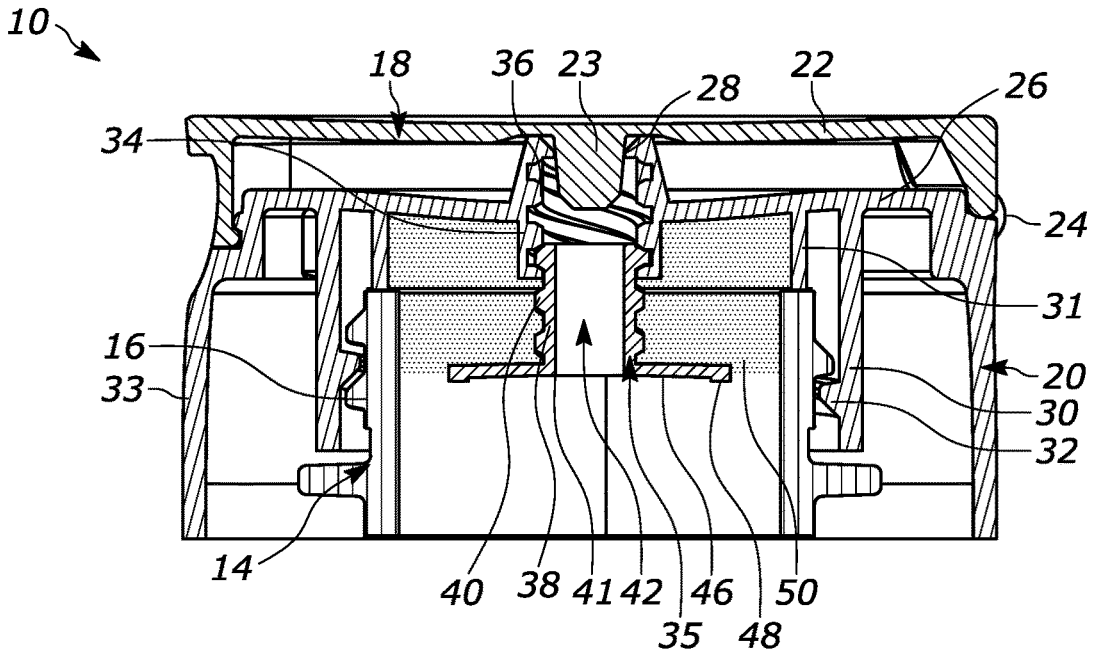
FIG. 4 is a cross-sectional view of the closure cap of the dispensing bottle of FIG. 1 attached to the container and with the extendable tube in the extended configuration.
Figure 5:
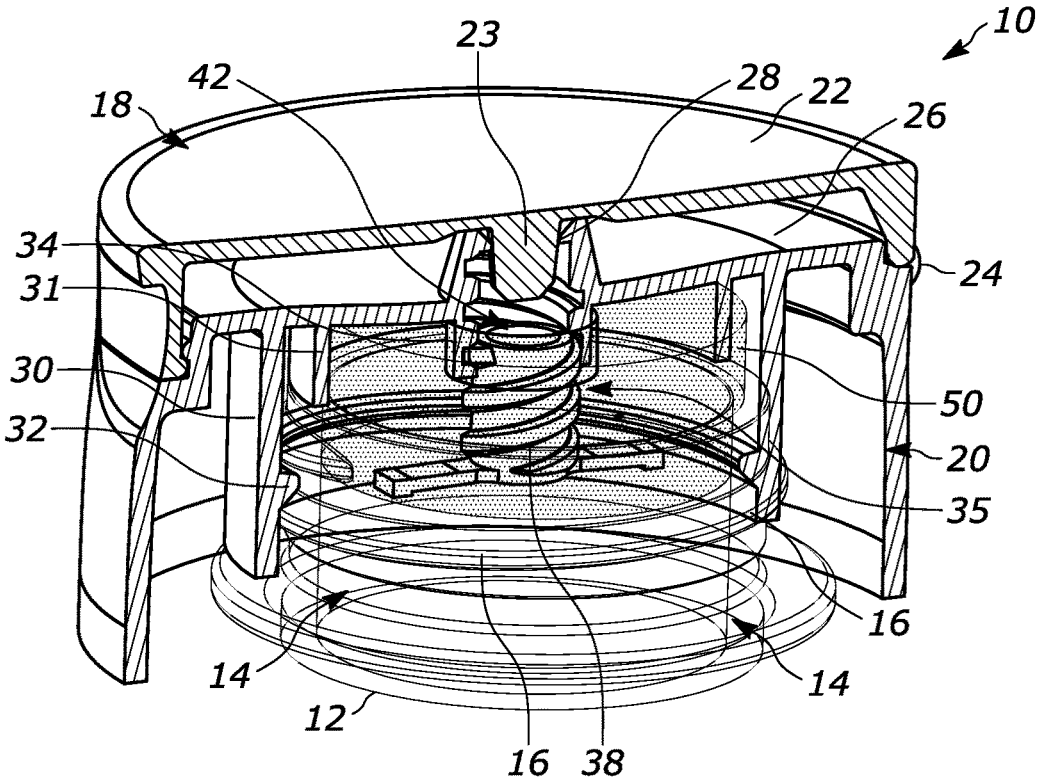
FIG. 5 is a perspective partial cross-sectional view of the dispensing bottle of FIG. 1 shown with the closure cap attached to the container with the extendable tube in the extended configuration.

With respect to FIGS. 4 and 5, once the closure cap 18 has been removed from the container body 12 and the liner 44 removed from the neck 14 of the container body 12, the closure cap 18 may be rethreaded to the container body 12 with the movable tube 38 in the extended configuration as shown. The movable tube 38 may extend into the neck 14 of the container body 12, beyond the plane where the liner 44 was, to move fluid from further into the bottle toward the exit opening and to form an expanded serum trap or well 50 to collect the serum that separated from the remainder of the fluid within the container body 12. The inlet end 41 of the movable tube 38 extends into the neck 14 of the container body 12 such that a portion of the serum well 50 is within the neck 14 of the container body 12. By expanding the serum well 50 into the container body 12, a serum well 50 having an increased volume is achieved without increasing the size of the closure cap 18.

The serum well 50 provides volume or space to collect or trap the serum that has separated from a remainder of the fluid and is disposed on the surface of the fluid proximal the closure cap 18 as the user inverts the dispensing bottle 10 to dispense fluid through the closure cap 18. For instance, after the dispensing bottle 10 has been in storage or unused for a period of time, the fluid within the dispensing bottle 10 may begin to separate. The serum or lower viscosity fluid may collect on the top surface of the fluid within the dispensing bottle 10 (when the closure cap 18 is disposed atop the container body 12). Where the dispensing bottle 10 is stored with the neck 14 at the upper end of the bottle 10, the serum collects on the top surface of the fluid that is proximate the dispensing opening 28 of the closure cap 18. As the dispensing bottle 10 is inverted (e.g., turned upside-down so the neck 14/closure cap 18 is at the lower end of the dispensing bottle 10), the serum that separated from the remainder of the fluid in the dispensing bottle 10 may flow into the serum well 50 that is radially outward from the internal shaft 34 and movable tube 38. The serum rests on the central member 26 (when the dispensing bottle 10 is inverted) and, where the volume of the serum is less than the volume of the serum well 50, the serum is below the inlet end 41 of the movable tube 38 that is distal from the central member 26. The serum within the serum well 50 is thus not able to flow into the fluid flow channel 42 of the movable tube 38 and thus is not dispensed from the container body 12. Thus, an expandable serum well 50 is advantageous to provide a volume large enough to hold all of the serum or separated fluid. While the serum is trapped in the serum well 50, the non-separated fluid above the inlet end 41 of the movable tube 38 is still able to flow into the movable tube 38 and be dispensed. As the non-separated fluid rests on the separated serum in the serum well 50 and the non-separated fluid is dispensed from the dispensing bottle 10, the fluid may begin to remix with the separated serum. For example, the non-separated fluid may be forced to flow within the dispensing bottle 10 and within the serum well 50 and mix the serum back into the fluid.

The expanded serum well 50 is formed by the base 20 and the movable tube 38 of the closure cap 18 and the neck 14 of the container body 12. When the movable tube 38 is in the retracted configuration the serum well 50 has a first volume in the range of about 1 mL to about 5 mL, and in one specific example 2.5 mL. When the movable tube 38 is the extended configuration the serum well 50 has a second volume that is larger than the first volume and extends into the neck 14 of the container body 12. When the movable tube 38 is in the extended configuration, the serum well 50 may have a volume in the range of about 2 mL to about 12 mL, and in one specific example 5.5 mL. The expandable serum well 50 is thus able to retain a larger volume of fluid (e.g., separated fluid or serum) when the movable tube 38 is in the extended configuration. The expanded volume of the serum well 50 is able to be achieved without increasing the height or the volume of the closure cap 18 that extends above the plane formed by the liner 44/neck 14 of the dispensing bottle 10 by extending the serum well 50 into the neck 14 of the container body 12 once the liner 44 has been removed. By having a larger serum well 50, a greater volume of serum is able to be trapped therein and prevented from being dispensed from the dispensing bottle 10.

A method of making the dispensing bottle 10 also is provided herein. The container body 12 may be molded in a variety of processes to include the neck 14 defining an opening. The neck 14 may be formed at an end of the container body 12. The neck 14 may be molded to include neck threads 16 thereon. The container body 12 may be filled with a thixotropic fluid through the opening of the neck 14 of the container body 12. The thixotropic fluid may be a fluid food product or other consumer fluid products, such as those examples provided above. The closure cap 18 may be molded to include the base 20 and the flip-top lid 22 hingedly connected to the base 20 via hinge 24 (e.g., a living hinge). The base 20 may be molded with an opening 28 in the central member 26 and with the inner skirt 30, the annular ring 31, and/or the outer skirt 33 depending from the central member 26. The inner skirt 30 may include the threads 32 thereon configured to engage the threads 16 of the neck 14 of the container body 12. The base 20 may further be formed to include the internal shaft 34 having threads 36 thereon. The movable tube 38 may be molded with threads 40 thereon and attached to the internal shaft 34 such that the movable tube 38 may be rotated relative to the internal shaft 34 along the threads. The movable tube 38 may be threaded to the internal shaft 34 and moved to the retracted position. The movable tube 38 may be molded to include the extension 46 for engaging the seal liner 44.

The seal liner 44 may be applied to the container body 12 to seal the opening of the container body 12. In some forms, the seal liner 44 is applied directly to the container body 12 and the closure cap 18 later rotated relative to the container body 12 to thread the closure cap 18 to the neck 14 of the container body 12. The closure cap 18 may be rotated at least until the annular ring 31, movable tube 38, and/or or extension 46 of the closure cap 18 engages an upper face of the liner 44. The closure cap 18 may be rotated until the extension 46 of the movable tube 38 engages the upper surface of the liner 44. For example, the closure cap 18 may be rotated until the extension passes over or beyond a ridge or step of the liner 44 such that the extension engages the ridge or step of the liner 44 when rotated in the reverse direction and prevents the movable tube 38 from rotating substantially relative to the liner 44.

In other forms, the seal liner 44 may be positioned within the cavity formed by the inner skirt 30 and the central member 26 of the closure cap 18. The liner 44 may be positioned to rest on and/or be removably secured to the annular ring 31 and/or extension 46 of the of the movable tube 38. The closure cap 18 may be positioned on the neck 14 of the container body 12 with the liner 44 in the cavity of the closure cap 18 and rotated relative to the container body 12 to thread the closure cap 18 onto the neck 14 of the container body 12. The liner 44 may be brought into engagement with the neck 14 of the container body 12 and seal the opening in the neck 14. In some forms, heat may be applied to seal the liner 44 to the neck 14. For example, the liner 44 may be an induction seal and induction sealed to the neck 14 of the container body 12.

To use the dispensing bottle 10 once manufactured with the closure cap 18 secured to the container body 12 and the liner 44 affixed to the container body 12, a user may rotate the closure cap 18 in the direction of arrow 52 of FIG. 3 to unthread the closure cap 18 from the container body 12. The movable tube 38 of the extendable tube 35 engages the seal liner 44 and/or neck 14 of the container body 12 as described above such that the movable tube 38 is inhibited from rotating substantially with the closure cap 18 as the closure cap 18 is rotated relative to the container body 12. As the closure cap 18 is unthreaded from the container body 12, the movable tube 38 is unthreaded from the internal shaft 34 of the closure cap 18 thereby moving the movable tube 38 to the extended configuration such that the fluid flow channel 42 of the extendable tube 35 has an increased axial length.

Once the closure cap 18 is unthreaded from the container body 12, the seal liner 44 may be removed from the container body 12. The seal liner 44 may be removed by peeling the seal liner from the neck 14 of the container body 12. The seal liner 44 may include a tab that a user may grasp to aid in separating the seal liner 44 from the container body 12. The closure cap 18 may then be reattached to the container body 12 with the movable tube 38 in the extended configuration by rotating the closure cap 18 relative to the container body 12 to thread the closure cap 18 to the container body 12. The movable tube 38 extends into the neck 14 of the container body 12 and beyond the plane where the seal liner 44 previously was thus forming a serum well 50 having an expanded or increased volume that extends at least partially into the neck 14 of the container body 12. Thus, a larger serum well 50 may be provided with the dispensing bottle 10 without the need for a closure cap having an increased height or volume and without the need to provide a non-conventional seal or tamper evident feature. Moreover, the larger serum well 50 may be created without the end user having to take an additional step to increase the length of the extendable tube 35 or to form the expanded serum well 50 because the movable tube 38 is extended as the user unthreads the closure cap 18 from the container body 12. In other forms, however, the end user may adjust the length of the extendable tube 35 (e.g., move to the extended configuration) upon removing the closure cap 18 by rotating the movable tube 38 relative to the remainder of the closure cap 18. The user may then rethread the closure cap 18 to the container body 12 and dispense fluid from the container body 12 without dispensing the serum or separated fluid.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A dispensing bottle comprising:

a container body having a neck defining an opening and neck threads thereon;

a closure cap having a base and a flip-top lid hingedly connected to the base, the base including:

a central member with an opening for fluid to flow through, an inner skirt depending from the central member, the inner skirt having skirt threads corresponding to the neck threads to thereby secure the closure cap relative to the container body, and an internal shaft disposed on an interior surface of the central member and about the opening, the internal shaft having threads disposed thereon;

a movable tube that is threaded onto the internal shaft via corresponding threads to thereby form an expandable serum well; and a liner disposed at the neck of the container body and secured thereto;

wherein the movable tube has an extension that engages at least one of the neck of the container body and the liner such that when the closure cap is at least partially unthreaded from the container body, the movable tube is retained in position relative to the container body and the liner to thereby expand the expandable serum well as the closure cap is unthreaded from the container body.

2. The dispensing bottle of claim 1 wherein the expandable serum well is formed by the base and the movable tube, where the movable tube has a retracted position where the expandable serum well has a first height and the movable tube has an extended position where the expandable serum well has a second height, wherein the first height and the second height are defined by a distance between an interior surface of the central member and a distal end of the movable tube.

3. The dispensing bottle of claim 2 wherein the expandable serum well is configured to retain a larger volume of fluid in the extended position as compared to the retracted position.

4. The dispensing bottle of claim 1 wherein the extension of the movable tube includes one or more extension arms extending outward from the movable tube to engage at least one of the neck of the container body or the liner.

5. The dispensing bottle of claim 4 wherein the one or more extension arms include a pair of fins with a generally flat bottom that engage a top of the liner.

6. The dispensing bottle of claim 4 wherein at least one of the neck or the liner includes a ledge to retain the movable tube relative to the container body as a remainder of the closure cap is rotated relative to the container body.

7. The dispensing bottle of claim 6 wherein the closure cap further includes a stop to prevent the movable tube from completely disengaging from a remainder of the closure cap.

8. The dispensing bottle of claim 1 wherein a user removes the liner from the neck before the closure cap with the expandable serum well is rethreaded to the container body.

9. The dispensing bottle of claim 1 wherein the movable tube and the internal shaft form an extendable tube that has a first axial length and a second axial length, wherein the first axial length is employed for initial storage and shipping and the second axial length is employed for dispensing of the fluid through the opening of the closure cap.

10. The dispensing bottle of claim 1 wherein the expandable serum well is sized to permit mixing of fluid within the expandable serum well as fluid is forced through the opening of the central member.

11. A closure cap comprising:

a base including an inner skirt with threads to attach the closure cap to a container body, the base including:

a central member with an opening for fluid to flow through, a skirt depending from the central member, the skirt having skirt threads corresponding to neck threads of the container body to thereby secure the closure cap relative to the container body, and an internal shaft disposed on an interior surface of the central member and about the opening, the internal shaft having threads disposed thereon;

a flip-top lid hingedly connected to the base;

a movable tube threaded onto the internal shaft via corresponding threads to thereby form an expandable serum well; and a liner disposed at an end of an annular ring and secured thereto;

wherein the movable tube has an extension that engages the liner such that when the closure cap is subsequently at least partially unthreaded from the container body, the movable tube is retained in position relative to the container body and the liner to thereby expand the expandable serum well.

12. The closure cap of claim 11 further comprising an outer skirt disposed at an edge of the central member and downwardly depending therefrom.

13. The closure cap of claim 12 wherein the expandable serum well is formed by the base and the movable tube, where the movable tube has a retracted position where the expandable serum well has a first height and the movable tube has an extended position where the expandable serum well has a second height, wherein the first height and the second height are defined by a distance between an interior surface of the central member and a distal end of the movable tube.

14. The closure cap of claim 13 wherein the expandable serum well is configured to retain a larger volume of fluid in an expanded configuration when the movable tube is in the extended position as compared to a retracted configuration.

15. The closure cap of claim 11 wherein the movable tube includes one or more extension arms extending outward from the movable tube to engage at least one of a neck of the container body or the liner.

16. The closure cap of claim 15 wherein the one or more extension arms include a pair of fins with a generally flat bottom that engage a top of the liner.

17. The closure cap of claim 15 wherein the liner includes a ledge to retain the movable tube relative to the liner as a remainder of the closure cap is rotated relative to the container body.

18. The closure cap of claim 17 wherein the closure cap further includes a stop to prevent the movable tube from completely disengaging from a remainder of the closure cap.

19. A dispensing bottle comprising:

a container body having a neck defining an opening, the neck including threads thereon;

a seal liner having a lower surface secured to the container body to seal the opening and an upper surface opposite the lower surface; and a closure cap having a base including a dispensing opening and a skirt with threads thereon configured to engage the threads of the neck of the container body, the closure cap including an extendable tube forming a fluid flow channel to the dispensing opening, the extendable tube movable between a contracted configuration and an extended configuration having increased axial length relative to the contracted configuration, wherein the extendable tube is in the contracted configuration when the closure cap is initially threaded to the container body with the extendable tube engaging the upper surface of the seal liner and is moved to the extended configuration as the closure cap is unthreaded from the closure cap from the container body;

wherein the extendable tube includes a first portion secured to or extending from the base with first threads thereon and a second portion with second threads thereon and the second portion does not rotate relative to the neck of the container body when the closure cap is initially unthreaded from the container body to thereby unthread the second portion of the extendable tube from the first portion of the extendable tube.

20. The dispensing bottle of claim 19 wherein the second portion of the extendable tube engages the upper surface of the seal liner such that when the closure cap is rotated relative to the container body to initially unthread the closure cap from the container body, the upper surface of the seal liner inhibits the second portion of the extendable tube from rotating with the first portion of the extendable tube thereby unthreading the second portion of the extendable tube from the first portion of the extendable tube moving the extendable tube to the extended configuration.

21. The dispensing bottle of claim 20 wherein the upper surface of the seal liner is non-planar, the non-planar upper surface of the seal liner engaging the second portion of the extendable tube to prevent the second portion of the extendable tube from rotating substantially relative to the seal liner.

22. The dispensing bottle of claim 20 wherein the upper surface of the seal liner includes at least one of a step and a ridge.

23. The dispensing bottle of claim 20 wherein the second portion of the extendable tube includes an engagement base configured to engage the upper surface of the seal liner to prevent the second portion of the extendable tube from rotating substantially relative to the seal liner.

24. The dispensing bottle of claim 23 wherein the engagement base of the second portion of the extendable tube includes at least one tab extending radially outward from an axis of the extendable tube.

25. The dispensing bottle of claim 19 wherein the closure cap further includes a flip-top lid hingedly connected to the base such that the flip-top lid is movable between a closed position and an open position.

26. The dispensing bottle of claim 19 wherein when the seal liner is removed and the closure cap is rethreaded to the container body, the extendable tube having an increased axial length that extends into the neck of the container body.

27. A closure cap comprising:

a base including a dispensing opening and a skirt with threads thereon configured to engage neck threads of a container body; and an extendable tube extending from the base and forming a fluid flow channel to the dispensing opening, the extendable tube movable between a contracted configuration and an extended configuration having increased axial length relative to the contracted configuration, wherein the extendable tube is configured to be in the contracted configuration when the closure cap is initially threaded to the container body with an end of the extendable tube engaging an upper surface of a seal liner;

wherein the extendable tube includes a first portion fixed to or extending from the base, the first portion having first threads and a second portion having second threads thereon and wherein the second portion of the extendable tube is configured to move to the extended configuration as the closure cap is unthreaded from the container body while the second portion does not rotate relative to a neck of the container body when the closure cap is initially unthreaded from the container body.

28. The closure cap of claim 27 wherein the second portion of the extendable tube is configured to engage a seal liner affixed to the dispensing opening of the container body such that when the base is rotated relative to the container body to initially unthread the closure cap from the container body, the seal liner inhibits the second portion of the extendable tube from rotating with the first portion of the extendable tube thereby unthreading the second portion of the extendable tube from the first portion of the extendable tube and moving the extendable tube to the extended configuration.

29. The closure cap of claim 28 wherein the second portion of the extendable tube includes an engagement base configured to engage the seal liner to prevent the second portion of the extendable tube from rotating substantially relative to the seal liner.

30. The closure cap of claim 29 wherein the engagement base of the second portion of the extendable tube includes at least one tab extending radially outward from the extendable tube.

31. The closure cap of claim 28 wherein the closure cap further includes a flip-top lid hingedly connected to the base such that the flip-top lid is movable between a closed position and an open position.

* * * * *